US005930964A

United States Patent [19]

Boehning

[11] Patent Number: 5,930,964

[45] Date of Patent: Aug. 3, 1999

[54] COMPOSITE LIGHTWEIGHT BUILDING ELEMENT AND METHODS OF MAKING AND USING SAME

[76] Inventor: John W. Boehning, 1038 Chickesaw, Seneca, Mo. 64865

[21] Appl. No.: 09/018,389

[22] Filed: Feb. 4, 1998

[51] Int. Cl.[6] ..... E04C 1/40; E04B 2/08

[52] U.S. Cl. ..... 52/309.1; 52/612; 52/604; 52/598; 52/590.1; 52/375

[58] Field of Search ..... 52/309.1, 590.1, 52/591.3, 591.4, 592.5, 592.6, 596, 598, 603, 604, 605, 612, 311.1, 375, 367, 315

[56] References Cited

U.S. PATENT DOCUMENTS

| | | | |
|---|---|---|---|
| 772,476 | 10/1904 | Podmore | 52/596 X |
| 1,411,005 | 3/1922 | Dula | 52/596 X |
| 1,925,103 | 9/1933 | Loftus et al. | 52/375 X |
| 2,049,907 | 8/1936 | Hess | 52/375 X |
| 3,518,799 | 7/1970 | Bachner | 52/309.1 |
| 3,555,757 | 1/1971 | Volent | 52/309.3 |
| 3,740,911 | 6/1973 | O'Leary | 52/388 |
| 3,949,037 | 4/1976 | Volent | 264/129 |
| 4,075,805 | 2/1978 | Bongiovanni | 52/591.1 X |
| 4,241,554 | 12/1980 | Infantino | 52/592.1 X |
| 4,349,588 | 9/1982 | Schiffer | 427/230 |
| 4,407,104 | 10/1983 | Francis | 52/309.4 |
| 4,478,021 | 10/1984 | Person | 52/375 |
| 4,593,513 | 6/1986 | Stratton | 52/604 X |
| 4,831,802 | 5/1989 | Cromrich et al. | 52/612 X |
| 4,963,305 | 10/1990 | Cromrich et al. | 264/644 |
| 4,993,206 | 2/1991 | Pardo | 52/591.4 X |
| 5,526,630 | 6/1996 | Francis et al. | 52/745.19 |
| 5,788,423 | 8/1998 | Perkins | 52/604 |

*Primary Examiner*—Carl D. Friedman
*Assistant Examiner*—Winnie Yip

[57] ABSTRACT

A composite lightweight building element comprises a first layer of aggregate based material (7, 8 and 9) extruded, sprayed, molded or cast onto a lightweight base form (1) which becomes an integral part of the element. This element can be manufactured in a panel to emulate common face brick (52), a smooth or chipped surfaced cut stone (60) or a floor tile. Integral with the first and second layers are cooperating dovetail ridges and grooves (4) respectively which serve to provide mechanical locking between the layers and a strengthening to the first layer. Integral with the second layer are male and female interlocking members (6 and 6*a*) to facilitate installation, to resist air or water infiltration between the panels and to provide mechanical locking between panels.

19 Claims, 7 Drawing Sheets

COMPOSITE LIGHTWEIGHT BUILDING ELEMENT AND METHODS OF MAKING AND USING SAME

BACKGROUND

1. Field of Invention

The present invention relates generally to composite building elements with their attendant mounting systems, and more particularly to those building elements composing a group of wall facing and floor covering elements such as face bricks, cut stone and floor tile that are significantly lighter in weight than the more traditional non-composite building elements such as standard face brick, cut stone or floor tile, exhibits complete closure to the elements of weather, has improved insulating qualities, has improved structural attachment when compared to current lightweight face brick and cut stone, has simpler installation procedures, and which utilizes fewer and simpler ancillary items to complete the installation.

2. Description of Prior Art

Face brick, cut stone and/or floor tile, manufactured of materials which are permanent and non-deteriorating such as fired clay or concrete or natural stone, are installed as wall facing and floor covering materials world wide. Reasons for such acceptance include proven longevity, reasonable and permanent closure and resistance to the elements of weather, incombustibility and general appreciation of the styles and colors available which enhance the individual structures on which the face brick, cut stone and/or floor tile is installed. However, the preconception of the weight, necessity of skilled labor for installation and cost of the installed face brick, cut stone and/or floor tile system have been primary reasons for not using or even considering usage of brick, cut stone and/or floor tile except those regions where usage is presumed as normal or preferred, or where style and visual effect have been primary considerations. Another common preconception is that face brick, cut stone and/or floor tile cannot be installed on an exiting interior wall or floor without significant structural modifications because of the weight of the product. Still another preconception is that only professional masons are capable of proper installation of the material. Each of these preconceptions has some element of truth, but, as is often the case with preconceptions in general, these elements of truth have been exaggerated. Indeed, many reject the option of installing a wall faced with brick and/or cut stone or a floor covered with tile, even to the point of non-consideration, because of these preconceptions.

Inventors and the face brick, cut stone and/or floor tile manufacturing and installation industry have variously tried to meet these objections. Among the prior art generated by these attempts have been:

a. WEIGHT The problem of weight has been addressed with two general approaches:

1. Design. Prior art in the brick industry has been concentrated on decreasing the volume of material used in the manufacturing of each individual brick thereby reducing their attendant weight. The method of extruding holes parallel with respect to the face of the brick is universally known as prior art. The minimum weight achieved by this means, while maintaining sufficient strengths, has remained virtually constant for centuries. This has not lessened the conception of the wall facing product as being too heavy for many uses. Teachings include that by Gerald T. Francis in U.S. Pat. No. 4,407,104 (1983), which has, as the primary focus, thin bricks adhesively attached to an extruded polystyrene foam backing panel and each panel joined to the wall with clips which protrude through the joints in the foam panel to provide mechanical attachment to the brick joint mortar subsequently applied. The problem common with adhesives is still extant with this teaching. In addition, in order to achieve a finished wall surface, the mortar joints must be filled manually.

Another teaching is disclosed in U.S. Pat. No. 5,526,630 issued to Steven R. Francis et al (1996) wherein they utilize a formed panel with channels which accept preformed thin brick tiles frictionally inserted into said channels. There is an additional device which protrudes from the outer surface of the underlying panel into a space between the individual brick tiles. Which device acts as a mechanical attachment of the panel to the wall and to form positive attachment to brick joint mortar subsequently applied. This teaches a frictional fit of the individual thin brick tiles to the underlying panel which overcomes the adhesive problem, but introduces another problem of depending primarily on the thin mortar joints for stability of the wall facing. If struck by blowing or thrown objects on a portion of the facing which does not happen to be where there is located a mechanical stabilizer tied to the wall surface underneath, and since there is no other mechanical support for the brick except through said thin mortar joints, it is likely that the joint would be fractured thereby releasing the thin brick tile from its position.

Still another teaching is contained in U.S. Pat. No. 4,349,588 issued to Henry Schiffer (1982) where a monolific layer of modified cementious mortar is troweled onto an existing surface, subsequently scored, sealed and grouted to appear like brick or cut stone. The disadvantage of this teaching is that it is very labor intensive, requires a multitude of separate steps to accomplish, doesn't resist cracking because of it's monolific coating, requires someone skilled in the art to install and would be difficult to approach a visual replica of the material that it attempts to emulate.

2. Materials. Various materials or combinations of materials have been utilized to achieve a lighter weight brick or cut stone. A common method has been taught by G. L. Bachner in U.S. Pat. No. 3,518,799 (1970) and S. C. Volent in U.S. Pat. Nos. 3,555,757 and 3,949,037 (1967 and 1976 respectively) is to utilize a brick, simulated or real, either cut, pressed or extruded to a thickness of about one-half inch (½") or less and then attaching it to the structure by utilizing adhesives. This has not been successful, especially on exterior surfaces because the adhesives are not good enough to provide permanent attachment and because the underlying surfaces must be absolutely sound, planer and without any presence of moisture behind or in them. A variation of this concept is taught by James D. O'Leary in U.S. Pat. No. 3,740,911 (1973) where the thin bricks are adhesively bonded using a "resin adhesive" to a substrate which is subsequently attached mechanically to the wall. A further variation of these attempts is taught by Cromrich et al in U.S. Pat. No. 4,963,305 where a light weight, insulating facing brick is provided with a first outer layer formed from conventional bricking clay and a second insulative layer formed from a combination of clay and expanded vermiculite.

Although these approaches do indeed result in a lightweight or lighter weight wall facing material, other conceptual and actual problems arise in their usage. For instance, the current state of the art in the plastics industry does not allow for a material that is not attacked by Ultra-Violet (UV) rays from the sun in the long term, thereby obviating any possibility of true permanence as a wall facing product when compared to concrete or clay face brick, cut stone and/or floor tile. Additionally, plastics are expensive and do not present a visual equality to the natural materials which they seek to emulate—they look "plastic". The dual composite teaching must still utilize expensive and increasingly difficult to find skilled masons to accomplish installation. In the concrete brick industry, various attempts have been made to utilize lighter weight materials, such as expanded shale or clay, to replace some of the normal graded sand as aggregate in the concrete mix. The resulting brick weighs less (about two-thirds the weight) than a normal aggregate mix, but is not as strong and is more absorbent, thereby making it more difficult to use.

b. COST Prior art will be discussed in two parts; initial cost and manufacturing.

1. Initial costs of concrete brick, cut stone and/or floor tile are competitive. However, the costs of re-bracing an existing structure compel many to reject the use of brick, tile and/or stone to re-face the walls or floors (interior or exterior) of their home. Also, masons required to lay common brick, floor tile and/or cut stone who are skilled workers who demand high wages.

2. The capital costs to install a manufacturing facility for the extrusion or molding of concrete face brick, floor tile and/or cut stone are considerable. A significant portion of the cost is in the purchase of the forms on which the brick, tile or stone are extruded. Additionally, if more than one size of brick, tile or stone is desired to be produced, the additional forms on which to extrude that size must be purchased. Variations in thickness or any other dimension are impossible because of the shape imposed, in major part, by the forms and by thicknesses necessary to achieve adequate installed strengths. The weight of the finished product limits the effective reasonable shipping radius, limiting the market area to about a 200 mile radius from the manufacturing facility.

OBJECTS AND ADVANTAGES

Accordingly, besides the objects and advantages of a face brick, cut stone and/or floor tile system described in my above patent, several objects and advantages of the present invention are:

(a) to provide a face brick, cut stone and/or floor tile which has a permanent covering material extruded, sprayed, molded or cast onto a lightweight base which becomes a permanent part of each brick, stone and/or floor tile.

(b) to provide a lightweight face brick, cut stone and/or floor tile which has the same visual appearance to the style and size of the brick, stone and/or floor tile which it emulates.

(c) to provide a face brick, cut stone and/or floor tile which is significantly lighter in weight than even the currently produced lightweight concrete or clay face brick, cut stone and/or floor tile.

(d) to provide a lightweight face brick, cut stone and/or floor tile mold which does not depend exclusively on the adhesive qualities of the concrete shell to supply permanent attachment between the mold and the concrete shell extruded, sprayed, molded or cast onto it.

(e) to provide a lightweight face brick, cut stone and/or floor tile which is highly resistant to damage from airborne objects striking the surface of the face brick, cut stone and/or floor tile.

(f) to provide a lightweight face brick, cut stone and/or floor tile whose shape or style is easily changed or modified in manufacture without the necessity of purchase of preformed molds or forms.

(g) to provide a lightweight face brick, cut stone and/or floor tile which has a similar durability and life expectancy to the concrete or clay face brick, cut stone and/or floor tile currently produced.

(h) to provide a lightweight face brick, cut stone and/or floor tile which is demonstrably more simple to install and, therefore, more acceptable to ordinary masons, "do-it-yourselfers" and other installers.

(i) to provide a lightweight face brick, cut stone and/or floor tile which is quickly and inexpensively installed.

(j) to provide a lightweight face brick, cut stone and/or floor tile which is quickly and inexpensively manufactured.

(k) to provide a lightweight face brick, cut stone and/or floor tile which is inexpensively packaged and delivered to the job site.

(l) to provide a lightweight face brick, cut stone and/or floor tile system which uses fewer and less expensive ancillary items to complete the installation of the wall facing or floor covering system.

(m) to provide a lightweight face brick, cut stone and/or floor tile system which has significantly improved thermal characteristics.

(n) to provide a lightweight face brick, cut stone and/or floor tile system which does not depend exclusively on adhesives to provide permanent attachment to the structure to which it is affixed.

(o) to provide a lightweight face brick, cut stone and/or floor tile system which allows easy modifications in visual joint color or treatment on the job site.

Still further objects and advantages will become apparent from a consideration of the ensuing description and drawings.

DRAWING FIGURES

In the drawings, closely related figures have the same number but different alphabetic suffixes.

FIG. 1*a* shows a perspective view of a base form onto which the concrete covering will be extruded, sprayed, molded or cast. Which form is shown singularly for clarity.

FIG. 1*b* shows a perspective view of the finished face brick and the attendant mortar joint after extrusion, spraying, molding or casting a permanent covering material onto the base form of FIG. 1*a*.

FIG. 1*c* shows a sectional view through "c" of FIG. 1*b* of the finished face brick revealing the relative position and abutment of the covering material and the base form with the formed cooperating, abutting, interlocking and engaging male and female members.

FIGS. 1*d* and 1*f* show various views of the base form (second layer) of FIG. 1*a*.

FIG. 1*d* shows a front view of the base form (second layer) of FIG. 1*a*.

FIG. 1*f* shows a top view of the base form (second layer) of FIG. 1*a*.

FIG. 1*e* shows an end view of three (3) courses of the completed invention as installed on a side wall.

FIG. 1*g* shows a perspective view of the base form (second layer) of the preferred embodiment which will have 6 brick extruded, sprayed, molded or cast onto the outermost surface of the base form (second layer).

FIGS. 1*h* and 1*i* respectively show a single finished panel and 4 panels stacked together as installed on a sidewall.

FIG. 2 shows a corner brick of the present invention.

FIGS. 3 and 3*a* show a truncated stack of "half" brick as would be installed respectively on either side of a window or door opening.

Figure 1A:
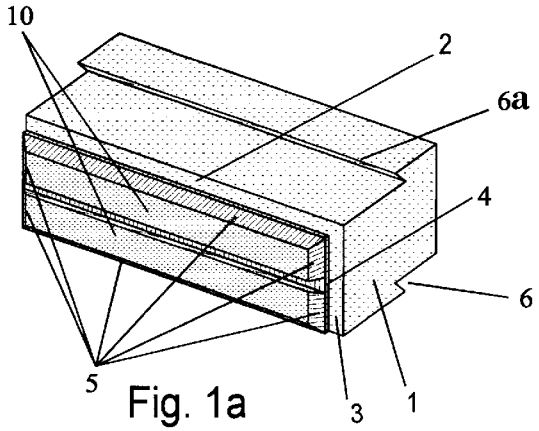
Figure 1B:
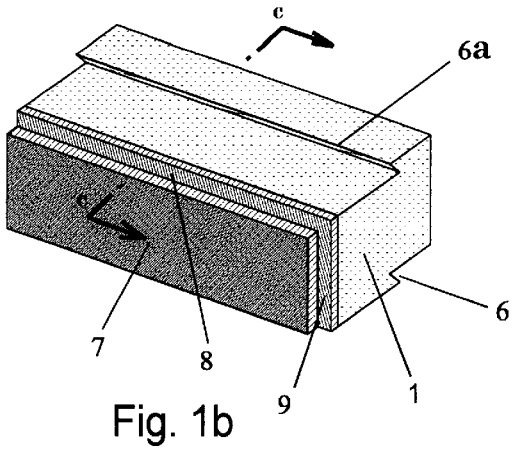
Figure 1C:
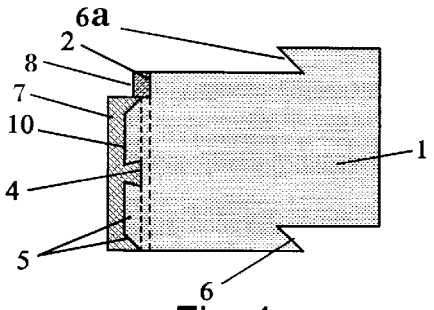
Figure 1D:
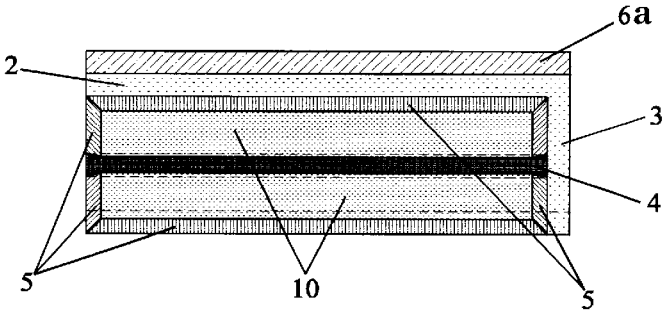
Figure 1E:
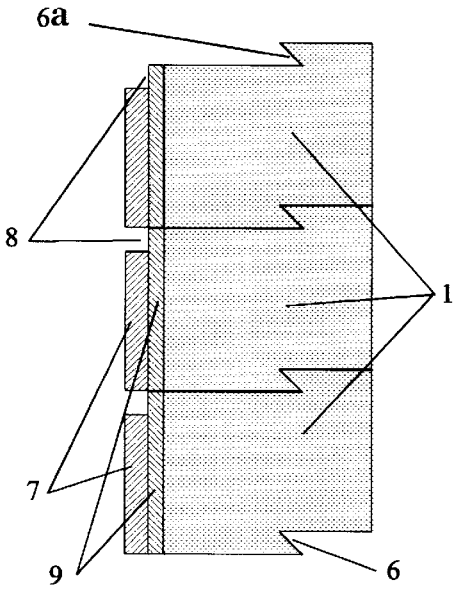
Figure 1F:
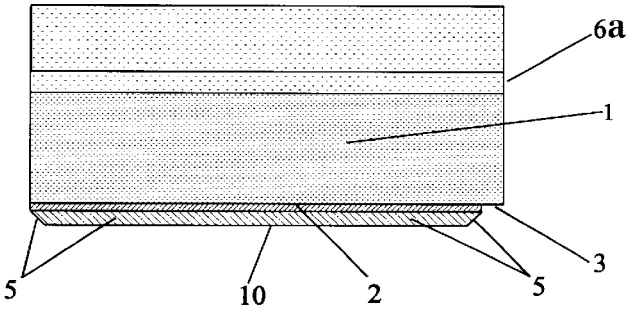
Figure 1G:
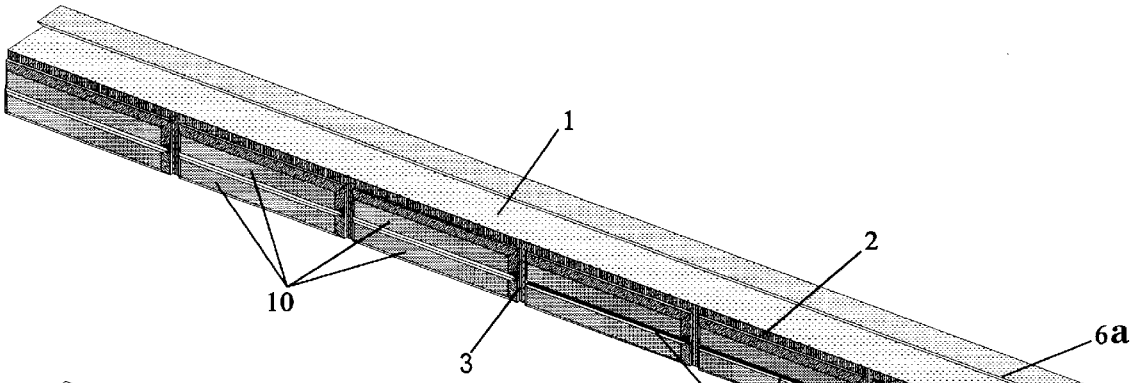
Figure 1H:
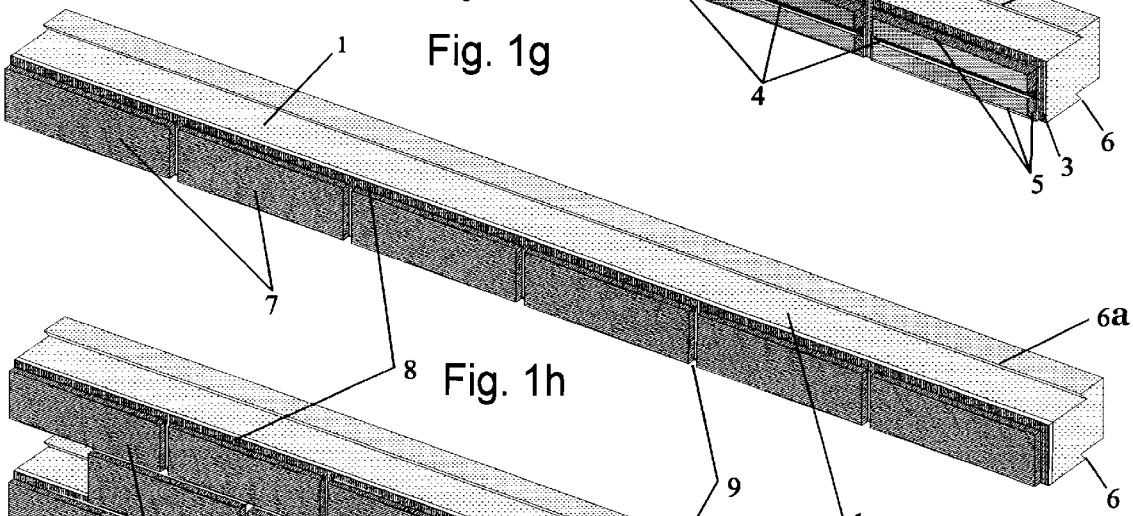
Figure 1I:
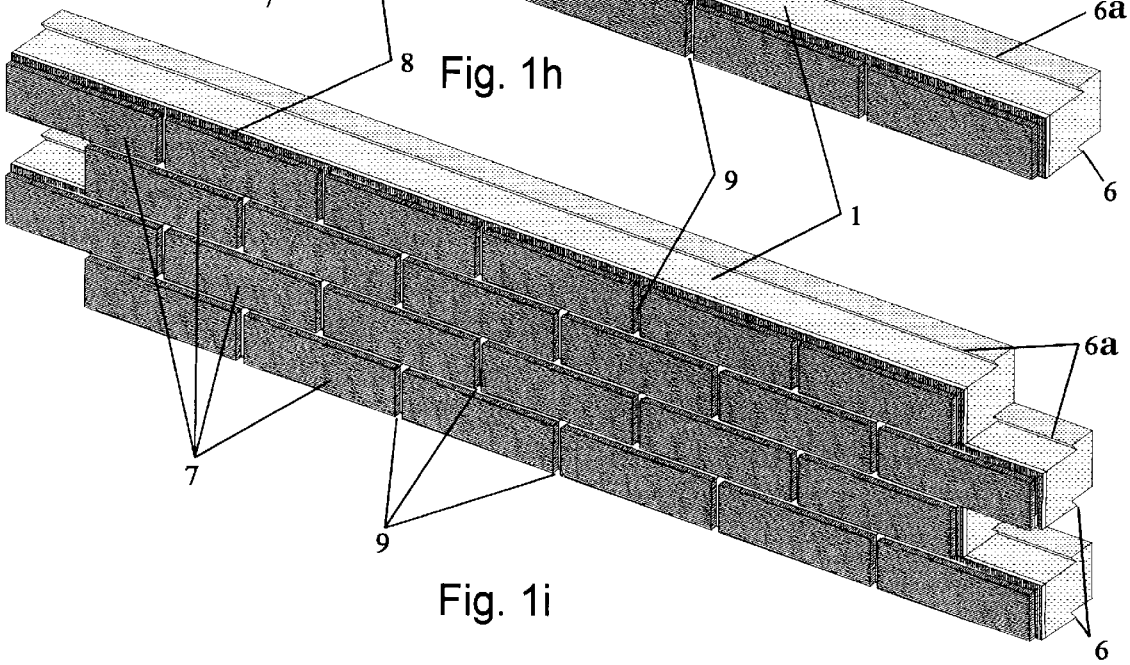
Figure 2:
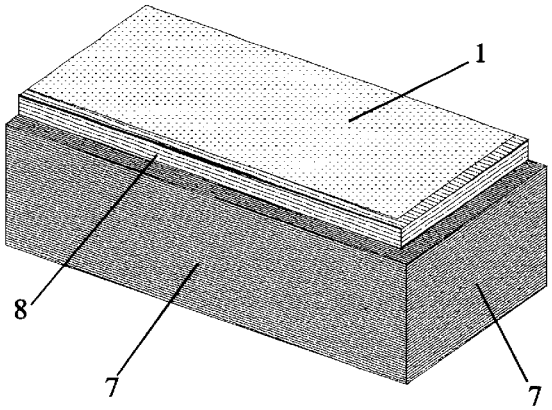
Figure 3:
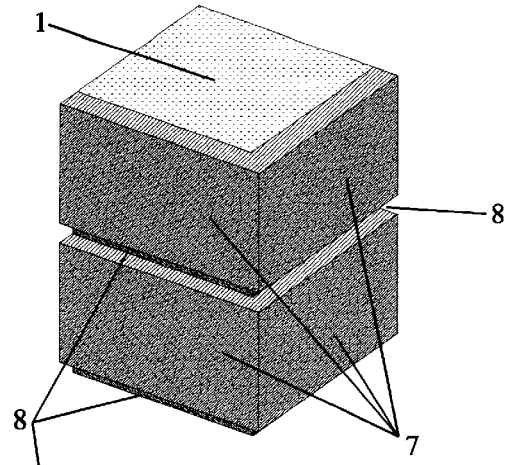
Figure 3A:
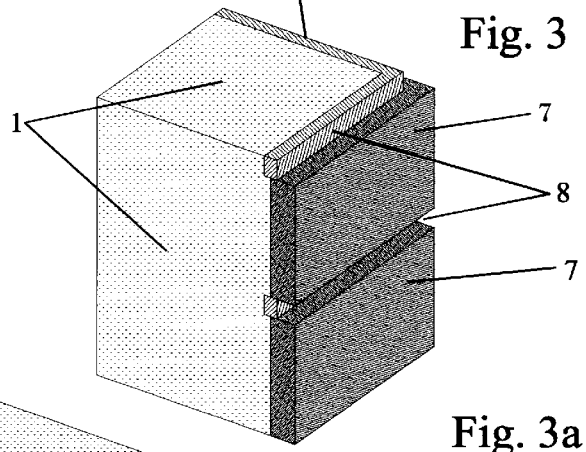
Figure 4:
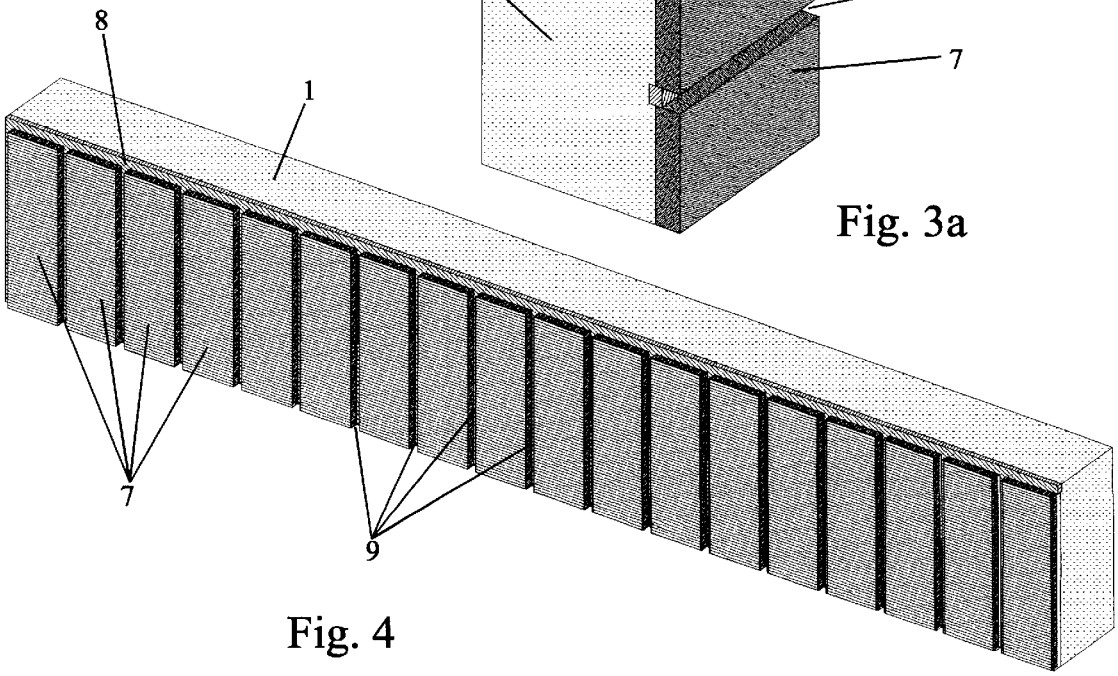
FIG. 4 shows a panel of "soldier" brick.
Figure 5:
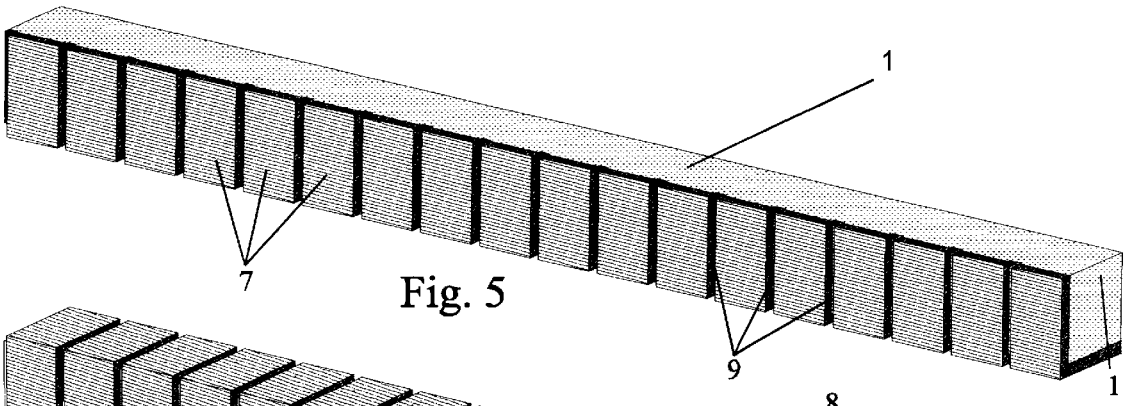
FIG. 5 shows a perspective view of a panel of "half" brick laid on the side to serve as a lintel above a window or door opening.
Figure 5A:
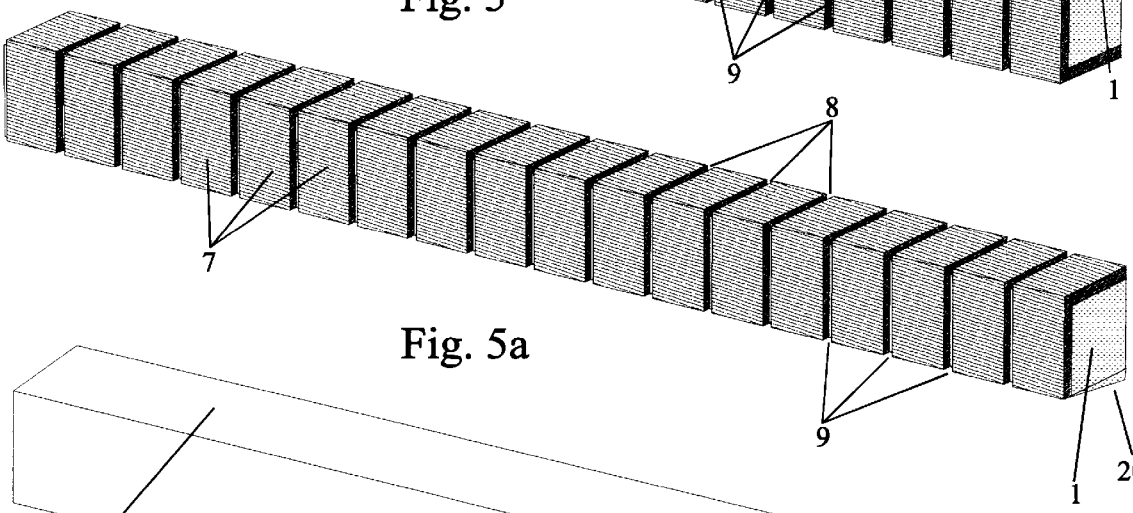

FIG. 5*a* shows a perspective view of a panel of "half" brick laid on the side with an additional strip of material of the same composition as the base form, which strip is a truncated triangle in cross section. This treatment results in an angled sill panel suitable for the sill of window or door openings.

Figure 5B:
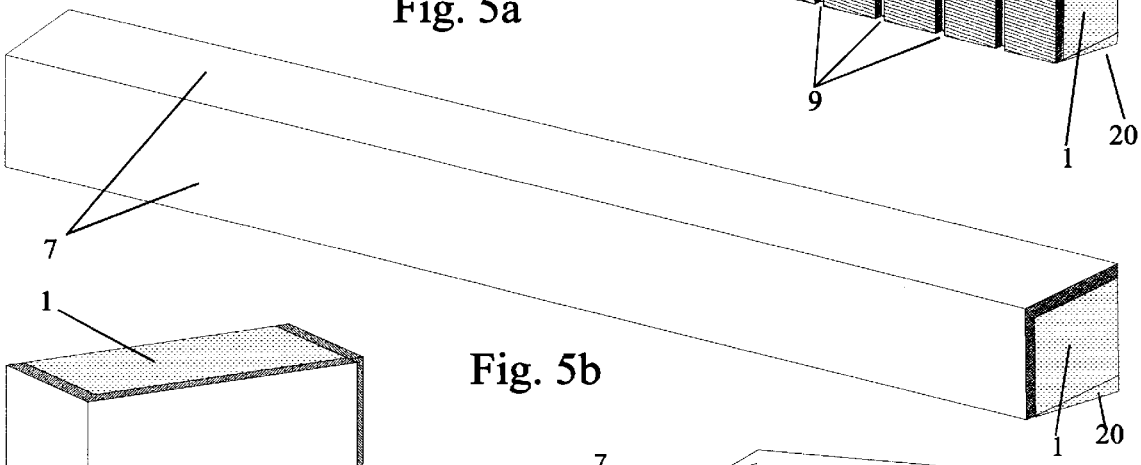

FIG. 5*b* shows a similar treatment of FIG. 5*a* when an appearance of a cut stone sill is desired.

Figure 6:
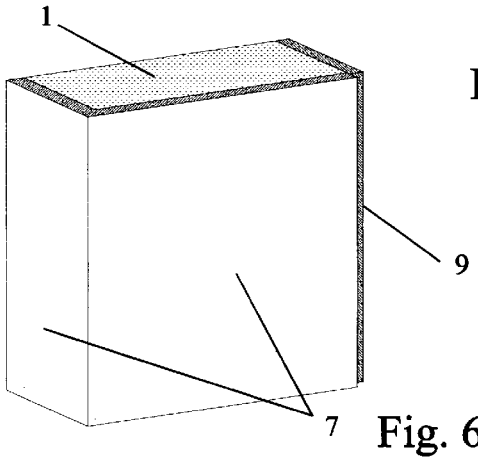

FIG. 6 shows a perspective view of a quoin emulating one of cut stone utilizing the combination of design and materials of the present invention.

Figure 6A:
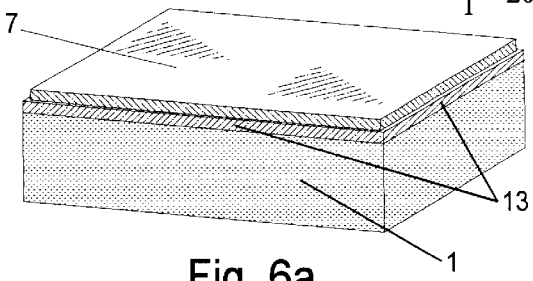

FIG. 6*a* shows a perspective view of a floor tile utilizing the combination of design and materials of the present invention.

Figure 7:
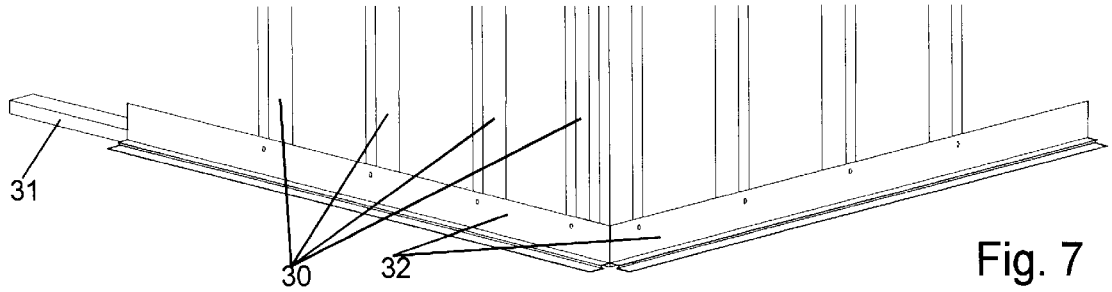
Figure 7A:
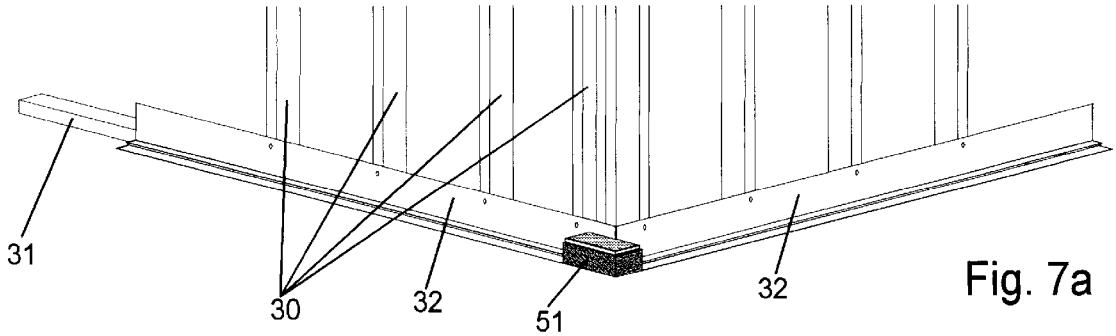
Figure 7B:
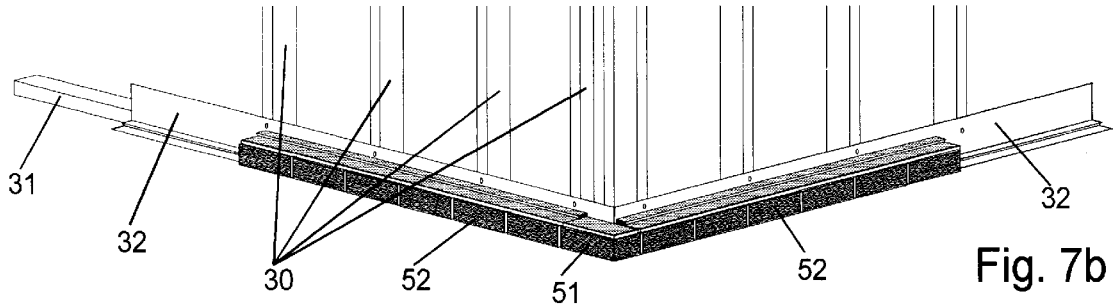
Figure 7C:
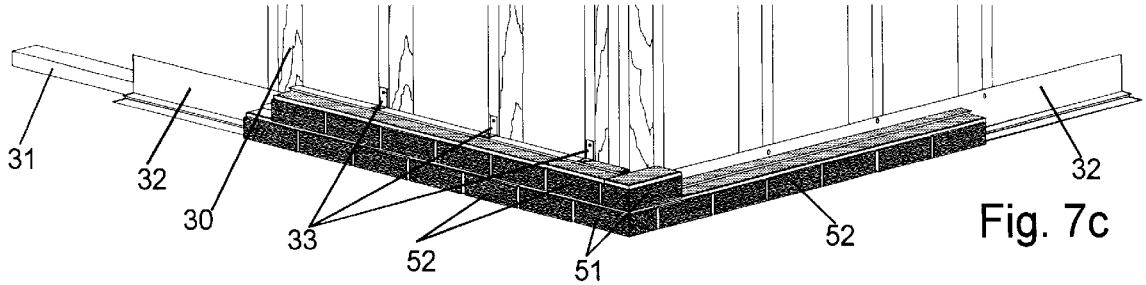

FIGS. 7 to 7*c* shows perspective views of the various steps recommended to commence the installation of this invention.

FIG. 7 shows a perspective view of a wall frame with a preformed metal brick ledge installed to commence the installation of the instant invention.

FIG. 7*a* adds a corner brick to the items in FIG. 7.

FIG. 7*b* adds brick panels to the items in FIG. 7*a*.

FIG. 7*c* adds another corner brick and brick panel to the items of FIG. 7*b*. The method of attachment of the panels to the underlying structure is also depicted.

Figures 8, 8A:
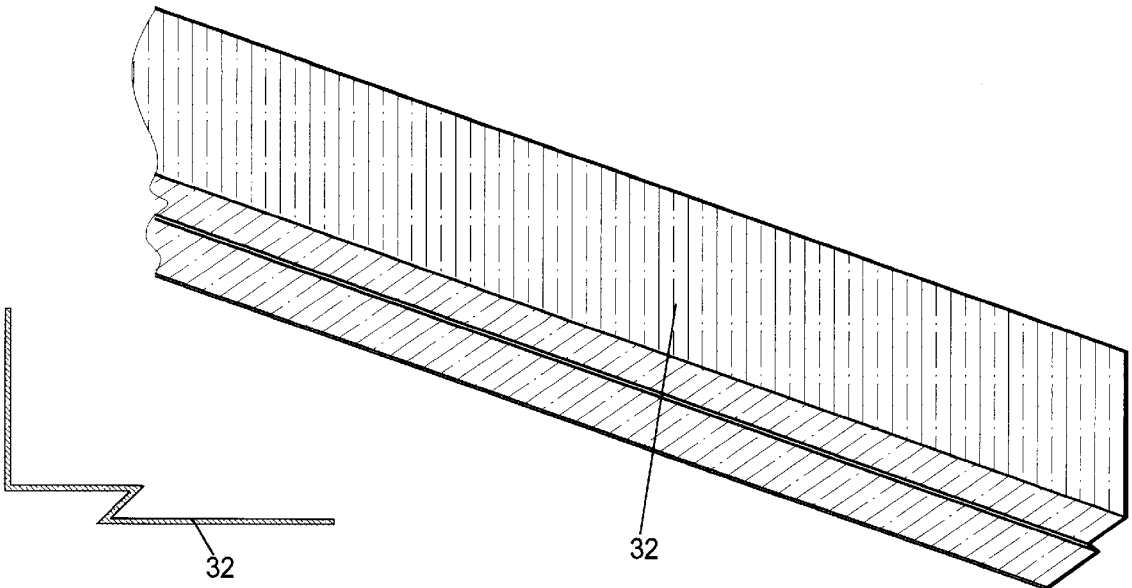

FIGS. 8 and 8*a* show various views of a ledge metal utilized on the interior or exterior of a structure where and when an existing brick ledge does not exist.

FIG. 8 shows a perspective view of the ledge metal.

FIG. 8*a* shows a cross sectional view of the ledge metal.

Figure 9:
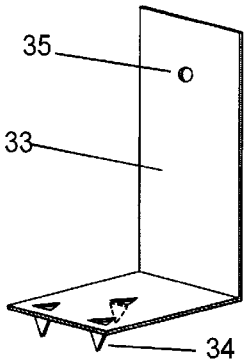
Figure 9A:
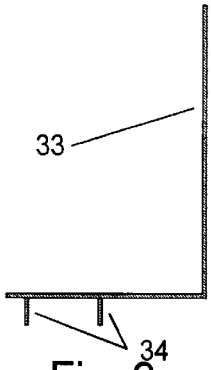
Figure 9B:
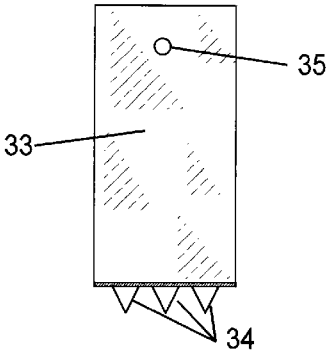
Figure 9C:
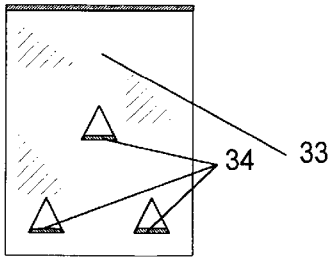

FIGS. 9 to 9*c* show various views of a "brick tie" which could be utilized to mechanically attach the brick panels of the present invention to a side wall or wall frame.

FIG. 9 shows a perspective view of a brick tie.

FIG. 9*a* shows an end view of the brick tie.

FIG. 9*b* shows a front view of the brick tie.

FIG. 9*c* shows a top view of the brick tie.

Figure 10:
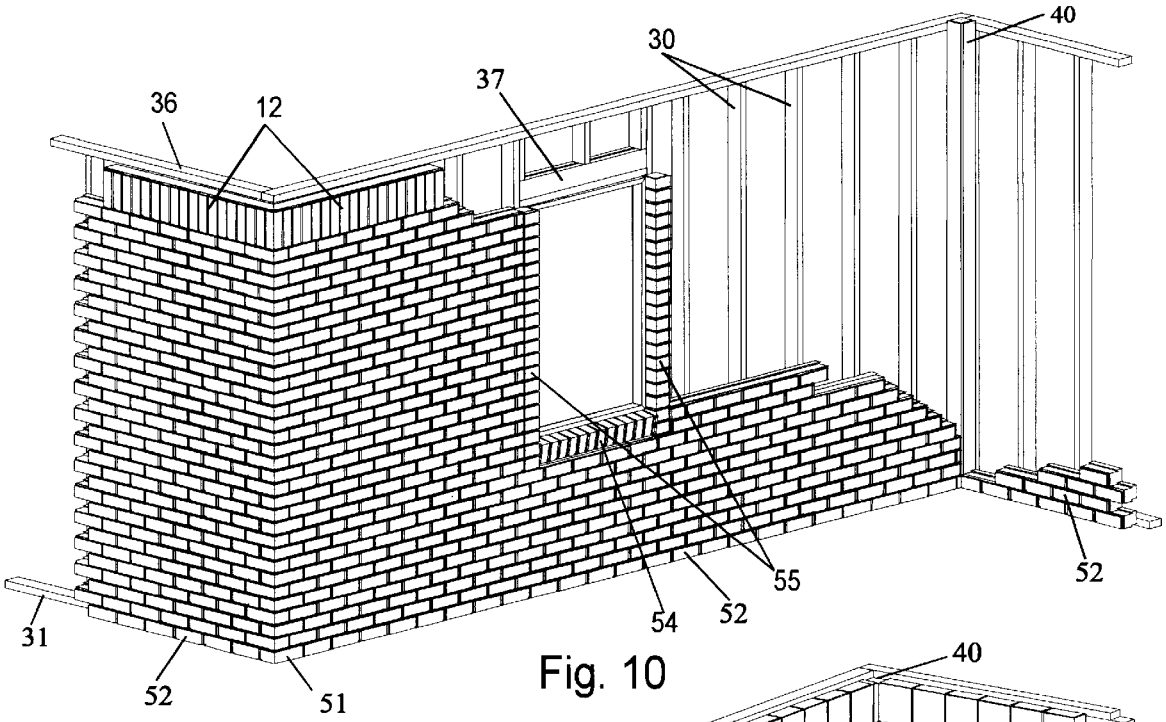

FIG. 10 shows the individual components shown in previous drawings when assembled or installed on a typical house frame.

Figure 10A:
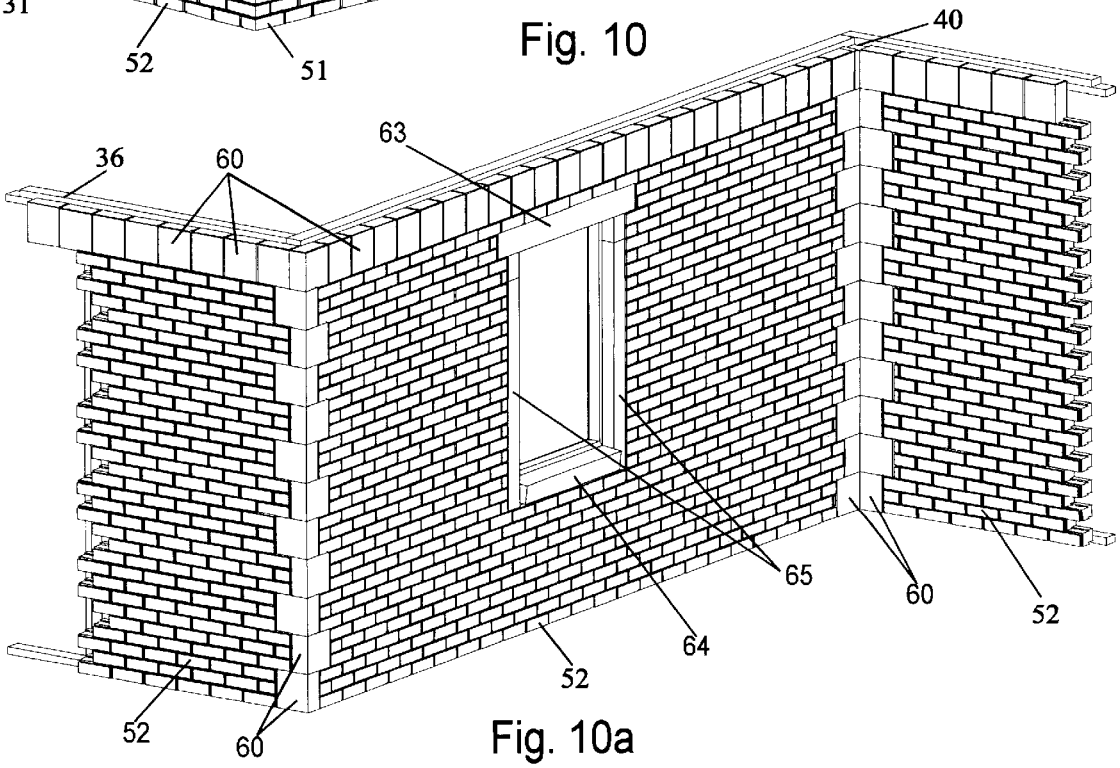

FIG. 10*a* shows the individual components shown in previous drawings when assembled or installed on a typical house frame, substituting the quoins of FIG. 6 for corner brick and soldiers and the cut stone appearing lintel, sill and "half stacks" of FIG. 5*b* for the respective brick panels.

REFERENCE NUMERALS IN DRAWINGS

1 Base Form (second layer)
2 Ledge for horizontal joint
3 Ledge for vertical joint
4 Dovetailed slot parallel to major axis of brick
5 Inclined peripheral sides of form
6 Female (lower) interlocking member of base form (second layer)
6*a* Male (upper) interlocking member of base form (second layer)
7 Outer face covering shell of brick, cut stone or floor tile
8 Horizontal mortar joint
9 Vertical mortar joint
10 Outer face of base form (second layer)
12 "Soldiers" panel
13 Mortar joint
20 Wedge shaped tilting member
30 Framing studs
31 Framing sill
32 Preformed metal brick ledge
33 Preformed brick tie
34 Engaging nibs of brick tie
35 Nail hole
36 Framing plate
37 Window header
40 Inside corner foam log (90 degree)
51 Whole corner brick
52 Brick panel
54 Brick window/door sill panel
55 Brick "half" stack
60 Quoins
63 Smooth lintel
64 Smooth sill
65 Smooth "half" stack

DETAILED DESCRIPTION OF THE ILLUSTRATED EMBODIMENT

Please refer to the accompanying drawings for the following explanation of the idea I conceived of as a resolution to the problems delineated and which met all of the goals sited.

I conceived of a method of extruding, spraying, molding or casting a thin-shelled concrete (or any other permanent material) brick, cut stone and/or floor tile and accompanying mortar joints onto a permanently attached, lightweight base. (See FIGS. 1*a*, 1*b*, 1*c*, 1*d*, 1*e*, 1*f*, 1*g*, 1*h*, 1*i*, 2, 2*a*, 3, 3*a*, 4, 5, 5*a*, 5*b*, and 6)

In FIGS. 1*a*, 1*b*, 1*c*, 1*d*, 1*e*, 1*f*, 1*g*, 1*h*, 1*i*, 2, 2*a*, 3, 3*a*, 4, 5, 5*a*, 5*b*, and 6, the base 1 can be any lightweight, easily and inexpensively available material which is also watertight; an example of which is EPS (Expanded Polystyrene) foam. The base, which can be of any thickness or shape to provide an appropriate undershape on which to extrude, spray, mold or cast the permanent shell to the desired surface shape, has several novel concepts:

NOTE: The particular application shown is to produce a flat, smooth surfaced rectangular face brick of common style and is not to be construed to be a limitation on the styles, shapes, or relative dimensions of a preferred embodiment of this invention. It should also be noted that a smooth or chipped faced cut stone or a floor tile could be manufactured utilizing the methods and components of this teaching.

The base form 1 depicted in FIGS. 1*a*, 1*b*, 1*c*, 1*d* and 1*f* is only for clarifying illustration of the instant invention in that it is truncated to only one brick in length. It should be appreciated that multiple bricks would be formed on a single long block in the preferred embodiment of this teaching as depicted more completely in FIGS. 1*g*, 1*h*, 1*i*, 3, 3*a*, 4, 5, 5*a* and 5*b*. The dimensions of this base form 1 are predicated by the desired size of the final brick and whether modularity is additionally desired. For instance, if the desired dimensions of the brick are to be 8 inches long (including the mortar joint), standard practice would dictate that said brick would be 2⅔ inches high (again including the mortar joint). The reason for this dimensional choice is so that a soldier course (FIG. 4) would be equal in height to three courses of common brick. If modularity is additionally desired, the base form 1 would be of such depth to allow a finished overall depth that is ½ of the length of one brick (including the mortar joint). In the above example, the overall depth of the base form 1 (including the covering material depth) would, therefore, be 4 inches. Utilizing these dimensions, the base form 1 of the preferred embodiment would be 48 inches long, 2⅔ inches high (ignoring the height of the male (upper) interlocking member) and, with an assumed depth of the covering material 7 to be ¼ inch, 3¾ inches in depth. Such dimensions yield a panel (FIGS. 1*g* and 1*h*) of 6 bricks. The length is chosen to be 48 inches so as to be a standard dimension utilized within the construction industry. It should be readily appreciated that this choice is arbitrary. The scope of the present invention should not be construed to be bounded in any way by dimensional considerations. However, utilizing these dimensions with 1½ pound density (per cubic foot) EPS foam as the base form material yield a panel which weighs approximately five and one half pounds, is structurally stable in transportation and handling, has a pleasing appearance, and incorporates an R-value of 16.

The peripheral sides 5 of the outer base are inwardly sloped toward the outer surface of the base 10 to provide for transverse strength of the eventually attached face brick covering material and for visual closure to the desired final shape of the face brick. Complete visual closure is not only important aesthetically but also to close the surface of the foam to the rays of the sun since the foam deteriorates only by exposure to such UV rays.

There are also "dovetail" slots or depressions 4, in cross section approximating a trapezoid, impressed into the outermost surface of the foam base 1 which are generally parallel to the major axis of the brick face 10, which slots receive part of the semi-viscous material (first layer) to be deposited onto the surface of said foam base (second layer) thereby forming cooperating interlocking male and female members between said covering material (first layer) and said base form (second layer). Which slots provide additional strengthening of the face brick and for mechanical attachment of the material (such as concrete) which is extruded or cast onto the base (second layer) during the manufacturing process. A further advantage of this arrangement is to not require any necessity of either an external adhesive to join the material to the base or a dependence on the inherent adhesive quality of concrete or other materials to permanently attach the material shell extruded, sprayed or cast onto the base. Obviously, the size, number, placement and/or shape of the slots referenced as 4 in these drawings are unimportant to the embodiment except that there be sufficient to provide adequate mechanical attachment between the base and cover material and to provide sufficient impact and flexural strength to the cover material.

The mortar joint ledges 2 and 3 provide a structural base on which the mortar joints 8 and 9 may be laid during manufacturing.

Male (upper) and female (lower) interlocking members of the base form (second layer), 6*a* and 6 respectively, are utilized for the following reasons:

1. The major mass of the panel 52 is located at the front of the panel causing a rotating moment around the major axis of the panel to be applied to the outermost surface of said panel 52 during installation. The cooperating interlocking members 6*a* and 6 resist this force, lending mechanical stability in the installation process.

2. Said cooperating interlocking members 6*a* and 6 mechanically resist air and water infiltration, thereby obviating the necessity of sealing the horizontal joint between successive panels 52 with additional sealants or adhesives.

3. Said cooperating interlocking members 6*a* and 6 mechanically provide location of one panel 52 to the preceding panels 52 in the course below and to the vertical joint between said preceding panels below which said upper panel covers. Which arrangement lends ease to the installation of the present invention by those unskilled in the art of masonry.

Similar cooperating and interlocking members could easily be produced on the ends of the panels as well.

The base form 1 of the preferred embodiment can be produced by pressure molding or by cutting a block of raw foam to the desired shape.

Refer to FIGS. 1*b*, 1*e*, 1*h*, 1*i*, 2, 3, 3*a*, 4, 5, 5*a*, 5*b* and 6. The face brick shell (first layer) 7 and the horizontal 8 and vertical 9 joints are then extruded, sprayed, molded or cast onto this base (second layer). The thickness and material can be varied, but in this application, and in the prototypes produced, a shell thickness of 63 mm (one-quarter inch) of concrete was used. If concrete utilizing standard graded sand as an aggregate is the covering material, the resulting face brick of the preferred embodiment, when installed on the side wall, will weigh approximately 900 pounds per thousand brick (which will cover approximately 212 square feet of side wall or, differently stated, cover approximately 26.5 lineal feet of an 8 foot high side wall). The current standardly produced clay brick weigh about 2700 pounds per thousand bricks and the currently produced concrete brick, even when using lightweight aggregates in their manufacture, weigh about 3000 pounds per thousand bricks. The weight of the mortar joints is not included in this calculation of the weight of standard bricks. If lightweight aggregates are utilized in the manufacture of instant invention, the even diminutive comparative weight as previously stated would be about ⅓ less, i.e. about 600 pounds per thousand brick.

A mortar-colored (or contrasting color) concrete is extruded, sprayed, molded or cast onto the joint ledges 2 and 3 along one side and one end of the panel and into the joints laterally 3 between each individual brick on the panel. These formed joints 8 and 9 are inset from the outermost face 7 of the covering about ⅜" and are ⅜" wide in the preferred embodiment. Subsequent to the installation of the panel 52 onto the receiving wall 30 and 31, these joints 8 and 9 may be further filled utilizing a caulking gun filled with a customer desired colored joint material to produce a virtually infinite variation in the joint color or treatment. Such joint treatment variation might include a flush or raked or even a weeping joint.

Alternatively, the joints 8 and 9 need not necessarily be formed as shown in FIGS. 5*b*, 6 and 10*b*. Such treatment could produce a simulated cut stone surface or, if proper molding techniques are utilized, a chipped stone surface. The possibilities of variation in produced styles, textures or the combination thereof of the instant invention are endless, bounded only by imagination.

Obviously, any rigid lightweight material could be utilized to function as the base (second layer) 1 for the extrusion, spraying, molding or casting of the covering material (first layer) 7 and joint material (first layer) 8 and 9.

The installation of this invention is a model of simplicity. Refer to FIGS. 7, 7*a*, 7*b*, 7*c*, 8, 8*a*, 9, 9*a*, 9*b*, 9*c*, 10*a* and 10*b* for the following description.

After mounting a preformed metal brick ledge 32, (or utilizing a pre-existing brick ledge) paying careful attention to variations in the framing structure, one commences by laying a corner brick 51 or a quoin 60 in place. Vertical corner strings and horizontal face course strings should be used to assure straightness and plumbness of the final installation. After mounting the corner brick 51, a panel of face brick 52 is laid on either side. The lateral joints between the brick panels 52 should be sealed with a thin adhesive or latex paint to insure closure to wind and rain penetration. After laying a course of panels 52, a second corner brick 51 is laid on top of the preceding corner brick 51 with the longer side pointing in the opposite direction as the longer side of the preceding corner brick 1. Brick panels 52 are slid into place by engaging the female (lower) interlocking member 6 of the panel with the male (upper) interlocking member 6*a* of the preceding course.

Attachment of the brick panel 52 to the wall framing members 30 is accomplished by pressing the underdepending nibs 34 of the brick tie 33 into the top of the foam base 1 of the brick panel 52, and then nailing the brick tie 33 to the framing member 30.

After continuing the above process upward and outward from the corner of the structure, the male (upper) interlocking member 6*a* of the final topmost course is trimmed off to receive the soldier panel 56 or quoin 60 if desired.

When one arrives at an opening in the wall, such as a window or door, one first lays the courses of brick 52 to the bottom of the opening, trimming the final course to the proper height to receive the sill brick, 54 and 64 in FIGS. 10 and 10*a*, between the window sill (or the door sill where necessary)and the final course. By preference, one then lays the "half" stacks 55 or 65 to the sides of the opening or cuts a panel 52 to said sides of the opening. Subsequently, one lays the lintel panel 63 (smooth) or FIG. 5 on top of the "half" stacks 55 or 65 or the brick panels 52 that have been continued up the sides of the opening.

Inside corners are first filled with a log of foam 40, substantially square in cross section, and attached to the underlying structure by adhesives or long nails. Panels 52 or quoins 60 are then butted up to and adhered to said foam logs 40. Although not shown, a similar treatment could be utilized to form any angle desired in the wall, for instance, the interior angle of a bay window. One only needs to cut a log of foam 40 (either precut or field cut on site) to the desired interior angle and proceed as described above.

A floor tile could be manufactured utilizing the improvements of the instant invention as shown in FIG. 6*a*. The base form 1 is covered with the aggregate facing material 7 and mortar joints 13. Which floor tile would be laid in place as any other floor tile. The advantages of this floor tile is that it is warm and cushioning so as to be more comfortable to stand on for long periods of time, especially when installed onto a poured concrete floor, and still retain the normal desirable properties of common floor tile.

Formation of these panels described in this teaching can proceed as follows:

1. The second layer 1 is first formed with the inclined edges 5, dovetail groves 4, male and female interlocking members 6 and 6*a*, and the joint ledges 2 and 3 in any known manner such as milling, slicing, cutting, routing, molding, and the like.

2. The first layer 7, 8 and 9 is then deposited onto the second layer 1 in two steps, one for the face component 7 and the second for the joint component 8 and 9. The method of deposition can be by extrusion, spraying, molding or casting the semi-plastic aggregate based first layer onto the second layer. Any of the said methods of deposition are well known in the art.

3. The composite panels 51, 52, 54, 55, 63, 64, 65 and 12 are then set aside to cure, forming the hardened first layer 7, 8 and 9 in which the aggregate based material has solidified within and upon each of the grooves 4 (thereby forming the cooperating interlocking male and female members between the first and second layers), inclines 5, and ledges 2 and 3 of the second layer 1.

The advantages of this invention over any other previously conceived include:

1. The surface coating is fully supported, therefore requiring significantly less thickness in the concrete shell to achieve superior strength to resist normal and extraordinary loads such as blown or thrown objects.

2. The exterior covering of the brick panel is fully insulated from the wall cavity behind, therefore there is no need for leaving a weep space behind the brick panel.

3. An "R" value will be added to the side wall that is equal to or greater than that normally found there, thereby either totally eliminating the need for further insulation of the wall cavity behind or adding valuable insulation (at no extra cost) while covering an existing exterior wall. This property effectively eliminates the labor and material normally utilized in the cavity insulation of the structure, consolidates this job with the installation of the exterior face material and, therefore, saves substantial amounts of money spent in the construction of the structure on which it is applied.

4. The combinative materials utilized in this invention do not form a vapor barrier, therefore no special allowance need to be made in construction to allow for venting of the cavity. This property, the closing of the exterior wall to wind penetration while allowing vapor to be transmitted through the exterior wall, increases the effective R value of the wall, as is well known in the art. In fact, a pinholed foil could optionally be laminated onto the back surface of the panel and would, because of the almost total re-radiation (reflection) of energy due to the foil face, as is also well known in the art, further reduce the heat transmission through the wall system.

5. The greatly diminished weight of this inventive product allows for substantial economic advantages, especially when compared to standard brick, when shipping it to a distribution center or to a job site. For the same reason, it is even much easier to distribute around the job site and up to any scaffolding that may be present.

6. It is much easier to cut and trim because of the greatly palliated mass and thickness of the covering material.

7. The necessity of utilizing skilled, expensive and increasingly unavailable masons in the installation of this face brick is obviated. Do-it-yourselfers can easily assemble this panel on the wall to which it will be attached without expensive or extensive tools and without experience in laying brick in the common sense. In fact, "common sense" and, perhaps, a general knowledge of common construction techniques are the only requisites to the satisfactory installation of this amazing product.

8. The panel of this invention can be utilized interiorly or exteriorly. Since adhesives are not included or needed in the recommended and herein described method of attachment of the brick panels to the supporting walls, delamination of the panel from the wall due to adhesive failure is also obviated. However, if desired, adhesives could be utilized interiorly if the backing material is sound and the nailing of the "ties" is obnoxious for some reason. It can be set on ordinary floors, even carpet covered ones, because the individual panels are attached to and supported by, in great measure, the wall to which they are attached.

9. The panel is also fire resistant. The covering material, if concrete (as in the preferred embodiment), is incombustible and the foam base is self-extinguishing. Installation of this product on the wall behind wood stoves, for instance, will be allowed and, in fact, will insulate and protect the wall behind from the heat of the radiant heat source. The instant inventive panel is also more energy efficient when compared to ordinary paneling, pressed wood products or other currently manufactured and specifically fire resistant panels which it may replace on the walls behind stoves or other radiant heat sources. This fact exists because the panel has more mass than any of these aforementioned products, effectively absorbing and storing the heat in the room where the heat source is located. Said panel neither passes the stored heat through to the room behind the wall on which it is attached (as could the other products) because of the insulative base on which the relatively massive face of the panel is affixed. Said panel rather re-radiates it's stored energy into the room in which it is located long after the active heat source is removed. This phenonom is well known in the art.

10. Joint treatment and color are easily and inexpensively variable on the job site using common tools and apparatii.

Accordingly, the reader will see that the face brick of this invention is indeed lightweight, is securely and easily extruded, sprayed, molded or cast onto it's cooperative base form, is resistant to outside shock loads, is watertight, is opaque to the wind, is not prone to delamination from the supporting wall due to adhesives, is not a vapor barrier, is quickly and inexpensively installed on an interior or exterior side wall without extensive skills or complicated accessory items or structures, is inexpensively shipped to the job site, is easily placed on and around the job site, has superior fire resistance, is easily and non-technically varied in joint treatment or color on the job site and has superior thermal properties to any previously conceived similar usage product. It should be apparent that this invention has additional advantages in that it easily allows for many configurations in style, materials and methods of manufacturing.

Many other advantages will be apparent to those skilled in the trade. The specific example of the invention as herein shown and described is for illustrative purposes only. Changes in methods of installation, style, shape, material constituents or ancillary items will be understood as forming a part of the present invention insofar as they fall within the spirit and scope of the appended claims. For instance, the individual panels might be joined adhesively rather than utilizing the male and female interlocking members of the preferred embodiment. Or, in other instance, the outermost surface need not be planer as shown and described in the preferred embodiment, but could have any surface shape desired.

I claim:

1. A composite wall facing or floor covering construction element comprising a first layer of aggregate based material having an outer or upper surface which in use forms the exterior surface of said wall facing or floor covering element and an inner or lower surface being in abutment with an outer or upper surface of a second layer, said second layer having a density less than that of said first layer, said second layer extending substantially to the rear of said first layer, wherein said abutting surfaces of said first and second layers include complementary interlocking engaging means comprising one or more male and female members and wherein said first layer is formed by depositing, extruding, casting or pouring said aggregate based material onto said second layer providing a single permanently joined entity, wherein said first aggregate based layer extends to cover around the entire complementary interlocking engaging means and all edges of the element which are visible in use.

2. A composite wall facing or floor covering construction element according to claim 1 wherein said element visually and practically emulates a common face brick.

3. A composite wall facing or floor covering construction element according to claim 1 wherein said element visually and practically emulates a smooth or chipped surfaced cut stone.

4. A composite wall facing or floor covering construction element according to claim 1 wherein said element visually and practically emulates a common floor tile.

5. A composite wall facing or floor covering construction element according to claim 1 wherein said aggregate based material is selected from the group consisting of a cementitious material, a polymer bound aggregate, a polymer bound sand, and any combination thereof.

6. A composite wall facing or floor covering construction element according to claim 1 wherein said second layer comprises an expanded polymeric material selected from the group consisting of polystyrene foam and polyurethane foam.

7. A composite wall facing or floor covering construction element according to claims 1 wherein said second layer comprises a lightweight concrete.

8. A composite wall facing or floor covering construction element according to claim 1 provided with a means of mechanically interlocking one element with the next element placed to the top or bottom or sides of the first element, which interlocking means provides a resistance to a turning and rotating moment.

9. A composite wall facing or floor covering construction element according to claim 1 wherein said second layer has inwardly sloped edges at the outermost surface with the depth of the slope corresponding to the desired visual depth of the first covering layer to accomplish the covering all edges of the element which are visible in use.

10. A composite wall facing or floor covering construction element according to claim 1 wherein one of said abutting surfaces is provided with one or more dovetail channels and the other of said abutting surfaces is provided with one or more complementary dovetail ridges which fit inside and are retained by said dovetail channels.

11. A composite wall facing or floor covering construction element according to claims 9 or 10 wherein said inwardly sloped edges of the second layer and said dovetail channels and ridges provide mechanical strengthening to the first layer.

12. A composite wall facing or floor covering construction element according to claim 1 wherein said element is provided with a means of positive mechanical attachment to an underlying building structure.

13. A composite wall facing or floor covering construction element according to claim 8 wherein said interlocking means consist of male and female members which in use engage each other when one element is installed to the side of a previous member.

14. A composite wall facing or floor covering construction element according to claim 8 wherein said interlocking means consist of male and female members which in use engage each other when one element is installed on top of a previous member.

15. A composite wall facing or floor covering construction element according to claim 1 wherein said element is provided with a means of adhesive and/or sealing joining to the next element to the side and/or to the top.

16. A composite wall facing or floor covering construction element comprising a first layer of aggregate based material having an outer or upper surface which in use forms the exterior surface of said wall facing or floor covering element and an inner or lower surface being in abutment with an outer or upper surface of a second layer, said second layer having a density less than that of said first layer, said second layer extending substantially to the rear of said first layer, wherein said abutting surfaces of said first and second layers include complementary interlocking engaging means comprising one or more male and female members, wherein said first layer is formed by depositing, extruding, casting or pouring said aggregate based material onto said second layer providing a single permanently joined entity, wherein said first aggregate based layer extends to cover around the entire complementary interlocking engaging means and all edges of the element which are visible in use, and wherein said second layer is provided with a means of depositing a second color of said aggregate based material of said first layer on one or more sides of the peripheral edges of said first layer.

17. A composite wall facing or floor covering construction element of claim 16 wherein said peripheral edges comprising said second color of aggregate based material of said first layer are depressed in respect to the outermost surface of said first layer thereby emulating a struck joint between and within said elements.

18. A composite wall facing or floor covering construction element of claims 16 or 17 wherein said second color of aggregate based material of said first layer comprises a different material.

19. A composite wall facing or floor covering construction element comprising a first layer of aggregate based material having an outer or upper surface which in use forms the exterior surface of said wall facing or floor covering element and an inner or lower surface being in abutment with an outer or upper surface of a second layer, said second layer having a density less than that of said first layer, said second layer extending substantially to the rear of said first layer, wherein said abutting surfaces of said first and second layers include complementary interlocking engaging means comprising one or more male and female members, wherein said second layer is provided with a means of depositing a second color of said aggregate based material of said first layer on one or more sides of the peripheral edges of said first layer, wherein said first layer is formed by depositing, extruding, casting or pouring said aggregate based material onto said second layer providing a single permanently joined entity, wherein said first aggregate based layer extends to cover around the entire complementary interlocking engaging means and all edges of the element which are visible in use, and wherein said second layer is provided with an interlocking means consisting of male and female members on opposite surfaces which in use engage each other when one element is installed on or beside a previous member.

* * * * *